US008979235B2

(12) United States Patent
Ishida et al.

(10) Patent No.: US 8,979,235 B2
(45) Date of Patent: Mar. 17, 2015

(54) CONVEYANCE APPARATUS AND RECORDING APPARATUS

(71) Applicant: Canon Kabushiki Kaisha, Tokyo (JP)

(72) Inventors: Takaaki Ishida, Kawasaki (JP); Yuki Emoto, Tokyo (JP); Shuichi Tokuda, Kawasaki (JP); Junichi Hirate, Kawasaki (JP); Kiyoshi Masuda, Kawasaki (JP); Tomoyuki Saito, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 4 days.

(21) Appl. No.: 14/021,310

(22) Filed: Sep. 9, 2013

(65) Prior Publication Data

US 2014/0078210 A1 Mar. 20, 2014

(30) Foreign Application Priority Data

Sep. 14, 2012 (JP) ..... 2012-203088

(51) Int. Cl.

| | |
|---|---|
| ***B41J 29/38*** | (2006.01) |
| ***B41J 17/28*** | (2006.01) |
| ***B41J 13/00*** | (2006.01) |
| ***B41J 11/46*** | (2006.01) |

(52) U.S. Cl.

CPC ..... *B41J 13/0009* (2013.01); *B41J 11/46* (2013.01); *B41J 13/0027* (2013.01)

USPC ..... 347/16; 347/217

(58) Field of Classification Search

USPC ..... 347/16, 171, 211, 213–215, 217–219; 400/611, 613, 618

See application file for complete search history.

(56) References Cited

U.S. PATENT DOCUMENTS

| | | | | |
|---|---|---|---|---|
| 6,341,905 | B1 * | 1/2002 | Suzuki | 347/16 |
| 7,744,187 | B2 * | 6/2010 | Iwakura | 347/16 |
| 8,562,098 | B2 * | 10/2013 | Yasutani et al. | 347/16 |

FOREIGN PATENT DOCUMENTS

| | | | |
|---|---|---|---|
| JP | 3988996 | B2 | 10/2007 |

* cited by examiner

*Primary Examiner* — Kristal Feggins

(74) *Attorney, Agent, or Firm* — Canon USA Inc. IP Division

(57) ABSTRACT

The conveyance apparatus includes a first conveyance unit configured to convey a sheet in a conveyance direction, and a second conveyance unit disposed on a downstream side of the first conveyance unit in the conveyance direction and configured to convey the sheet in the conveyance direction. The conveyance apparatus corrects a rotational amount of each conveyance unit using a correction value dedicated to each rotational phase of each conveyance unit for each conveyance state, in a first conveyance state in which the first conveyance unit is operative to convey the sheet, a second conveyance state in which the first and second conveyance units are cooperative to convey the sheet, and a third conveyance state in which the second conveyance unit is operative to convey the sheet.

12 Claims, 13 Drawing Sheets

FIG.5

TABLE 1

| | PERIODIC CONVEYANCE VARIATION AMOUNT D | |
|---|---|---|
| | FIRST CONVEYANCE STATE (CONVEYANCE USING MAIN CONVEYANCE ROLLER) | THIRD CONVEYANCE STATE (CONVEYANCE USING DISCHARGE ROLLER) |
| S1 | DLF1 | DEJ1 |
| S2 | DLF2 | DEJ2 |
| S3 | DLF3 | DEJ3 |
| S4 | DLF4 | DEJ4 |
| S5 | DLF5 | DEJ5 |
| S6 | DLF6 | DEJ6 |
| S7 | DLF7 | DEJ7 |
| S8 | DLF8 | DEJ8 |

FIG.8

TABLE 2

| TYPE | SIZE | α | |
|---|---|---|---|
| | | αLF | αEJ |
| A | LARGE | αLF_A_LARGE | αEJ_A_LARGE |
| | MEDIUM | αLF_A_MEDIUM | αEJ_A_MEDIUM |
| | SMALL | αLF_A_SMALL | αEJ_A_SMALL |
| B | LARGE | αLF_B_LARGE | αEJ_B_LARGE |
| | MEDIUM | αLF_B_MEDIUM | αEJ_B_MEDIUM |
| | SMALL | αLF_B_SMALL | αEJ_B_SMALL |
| C | LARGE | αLF_C_LARGE | αEJ_C_LARGE |
| | MEDIUM | αLF_C_MEDIUM | αEJ_C_MEDIUM |
| | SMALL | αLF_C_SMALL | αEJ_C_SMALL |

FIG.9

TABLE 3

| | PERIODIC CONVEYANCE VARIATION AMOUNT | |
|---|---|---|
| | ELF | EEJ |
| S1 | ELF1 | EEJ1 |
| S2 | ELF2 | EEJ2 |
| S3 | ELF3 | EEJ3 |
| S4 | ELF4 | EEJ4 |
| S5 | ELF5 | EEJ1 |
| S6 | ELF6 | EEJ2 |
| S7 | ELF7 | EEJ3 |
| S8 | ELF8 | EEJ4 |

FIG.11

TABLE 4

| | PERIODIC CONVEYANCE VARIATION AMOUNT | | |
|---|---|---|---|
| | CONVEYANCE STATE CA | CONVEYANCE STATE CB | CONVEYANCE STATE CC |
| S1 | TA1 | TB1 | TC1 |
| S2 | TA2 | TB2 | TC2 |
| S3 | TA3 | TB3 | TC3 |
| S4 | TA4 | TB4 | TC4 |
| S5 | TA5 | TB5 | TC5 |
| S6 | TA6 | TB6 | TC6 |
| S7 | TA7 | TB7 | TC7 |
| S8 | TA8 | TB8 | TC8 |

FIG.12

TABLE 5

| | CONVEYANCE ROLLER | | |
|---|---|---|---|
| | UPSTREAM ROLLER | INTERMEDIATE ROLLER | DOWNSTREAM ROLLER |
| $\alpha$ | $\alpha$A | $\alpha$B | $\alpha$C |

CONVEYANCE APPARATUS AND RECORDING APPARATUS

BACKGROUND OF THE INVENTION

1. Field of the Invention

The present invention relates to configuration and control of a conveyance apparatus in a recording apparatus that holds and conveys a recording medium with a conveyance unit and performs a recording operation.

2. Description of the Related Art

Image forming apparatuses (e.g., copying machines and printers) have been recently used to print photo images in many cases. Especially, an inkjet image forming apparatus has the capability of forming a high-quality image comparable to a silver-halide photo due to minimization of ink droplet or improvement in image processing technique.

To satisfy requirements for such high-quality images, high accuracy is required in the conveyance of a recording medium. A large problem in improving the conveyance accuracy is a periodic conveyance deviation that may derive from fluctuations occurring in a driving transmission unit (e.g., conveyance rollers and gears). In a case where a recording medium is conveyed by a driving transmission unit that causes large fluctuations, the conveyance amount of the recording medium periodically varies even when the rotational amount is constant. The image quality is dissatisfactory because of deterioration in the conveyance accuracy. To solve the above-mentioned problem, very high accuracy is required in manufacturing mechanism parts that constitute the recording apparatus.

However, the degree of improvement in the manufacturing accuracy is limited. Pursuing high accuracy in the manufacturing of mechanism parts will increase manufacturing costs significantly. Therefore, it is conventionally proposed to actually measure the conveyance amount for each rotational phase interval after each recording apparatus is manufactured and then obtain a correction value for the rotational amount of the conveyance roller based on a measurement result.

More specifically, a periodic conveyance variation amount correcting method, which includes acquiring a fluctuation amount or a periodic conveyance variation amount (i.e., an integration of fluctuations with respect to a predetermined rotational phase interval) of a conveyance roller based on actual measurement and correcting the conveyance amount based on the acquired value, is conventionally proposed. As discussed in Japanese Patent No. 3988996, it is conventionally known to prepare a print pattern usable to actually measure the fluctuation amount of a conveyance roller beforehand and acquire a fluctuation amount based on the pattern.

Further, it is conventionally known to predict a periodic conveyance variation amount based on the acquired fluctuation amount of the conveyance roller and the rotational position of the conveyance roller, in an actual printing operation, and correct the rotational amount of the conveyance roller in such a way as to make the conveyance amount constant.

In general, a main recording unit of the recording apparatus includes a recording head and a plurality of conveyance rollers provided on the upstream side and the downstream side of the recording head. The recording apparatus performs an image recording operation in the entire area of a recording medium. Therefore, the recording apparatus switches between a state in which only a single conveyance roller is operative to convey the recording medium and a state in which a plurality of conveyance rollers is cooperative to convey the recording medium.

Therefore, if the method discussed in Japanese Patent No. 3988996, which includes the conveyance variation amount prediction and the roller rotation correction, is employed for a recording apparatus that includes a plurality of conveyance rollers, it is feasible to correct the periodic conveyance variation amount in a state where the conveyance is performed using a single conveyance roller. However, it is unfeasible to perform the periodic conveyance variation amount correction in a state where a cooperative conveyance by a plurality of conveyance rollers is performed. Therefore, in an area where two or more conveyance rollers are cooperative to convey a recording medium in the recording apparatus that includes a plurality of conveyance rollers, a correction value to be applied to the conveyance when carried out by a single conveyance roller is used to perform the periodic conveyance variation amount correction.

As a result, increasing the conveyance accuracy in a cooperative conveyance state using a plurality of conveyance rollers is difficult even when the periodic conveyance variation amount correction is performed. The image quality in the corresponding area cannot be improved.

SUMMARY OF THE INVENTION

In view of the foregoing, the present invention is directed to a technique capable of performing correction based on a correction value corresponding to each conveyance state in which a single or a plurality of conveyance rollers is operative and capable of improving the conveyance accuracy irrespective of the conveyance state or the rotational phase of each conveyance unit.

According to an aspect of the present invention, a conveyance apparatus includes a first conveyance unit configured to convey a sheet in a conveyance direction and a second conveyance unit disposed on a downstream side of the first conveyance unit in the conveyance direction and configured to convey the sheet in the conveyance direction. The conveyance apparatus corrects a rotational amount of each conveyance unit using a correction value dedicated to each rotational phase of each conveyance unit for each conveyance state, in a first conveyance state in which the first conveyance unit is operative to convey the sheet, a second conveyance state in which the first and second conveyance units are cooperative to convey the sheet, and a third conveyance state in which the second conveyance unit is operative to convey the sheet.

The conveyance apparatus according to the present invention, which is configured as mentioned above, can improve the conveyance accuracy irrespective of the conveyance state or the rotational phase of each conveyance unit.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIG. 5 is a table 1 that stores setting values of a periodic conveyance variation amount D to be set for each rotational phase interval in each conveyance state.

FIG. 8 is a table 2 that stores setting values of a slip amount $\alpha$ that are classified according to the type and the size of a recording medium, which are stored in a ROM according to a second exemplary embodiment.

FIG. 9 illustrates a table 3 that stores setting values of two periodic conveyance variation amounts ELF and EEJ according to a third exemplary embodiment.

FIG. 11 illustrates a table 4 that stores periodic conveyance variation amounts to be set for respective rotational phase intervals in each conveyance state according to the fourth exemplary embodiment.

FIG. 12 illustrates a table 5 that stores conveyance characterization factor $\alpha$ that is required to calculate the periodic conveyance variation amount in each conveyance state according to the fourth exemplary embodiment.

DESCRIPTION OF THE EMBODIMENTS

Various exemplary embodiments, features, and aspects of the invention will be described in detail below with reference to the drawings.

Figure 1:
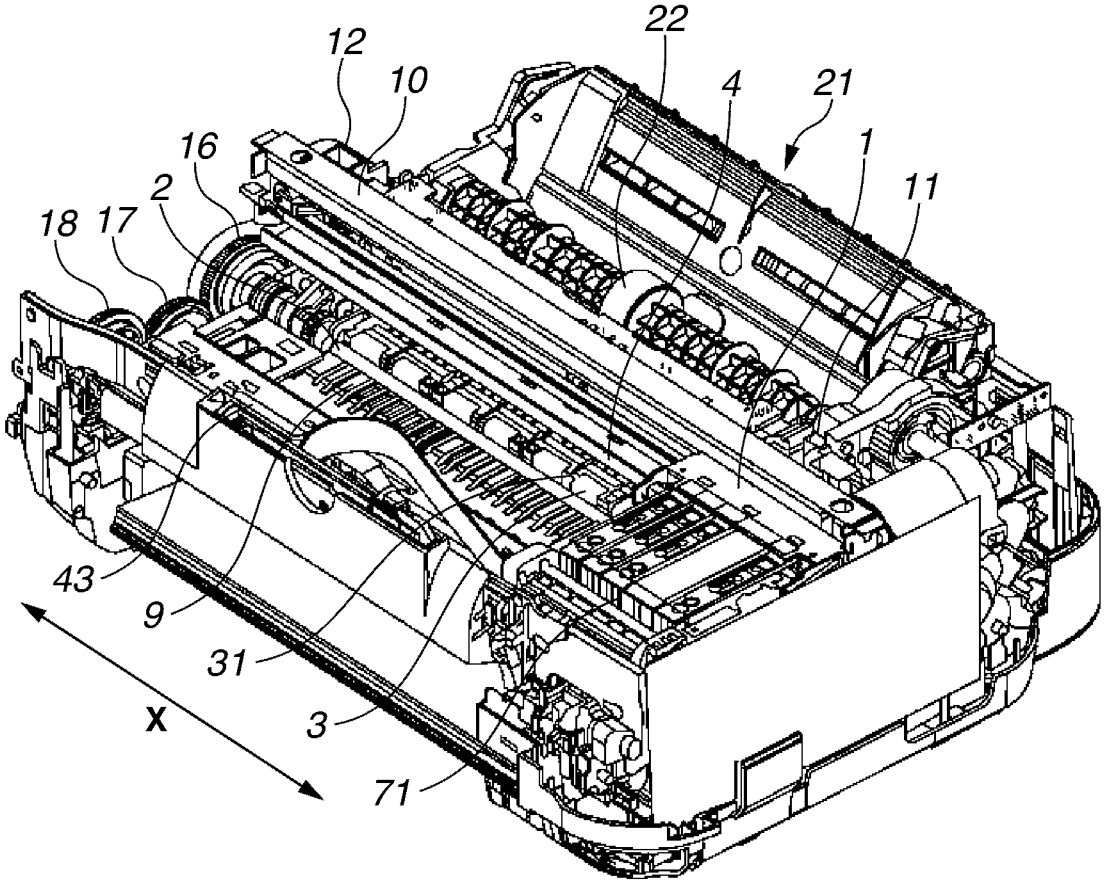
FIG. 1 is a perspective view illustrating a mechanism unit of a recording apparatus according to a first exemplary embodiment of the present invention.
Figure 2:
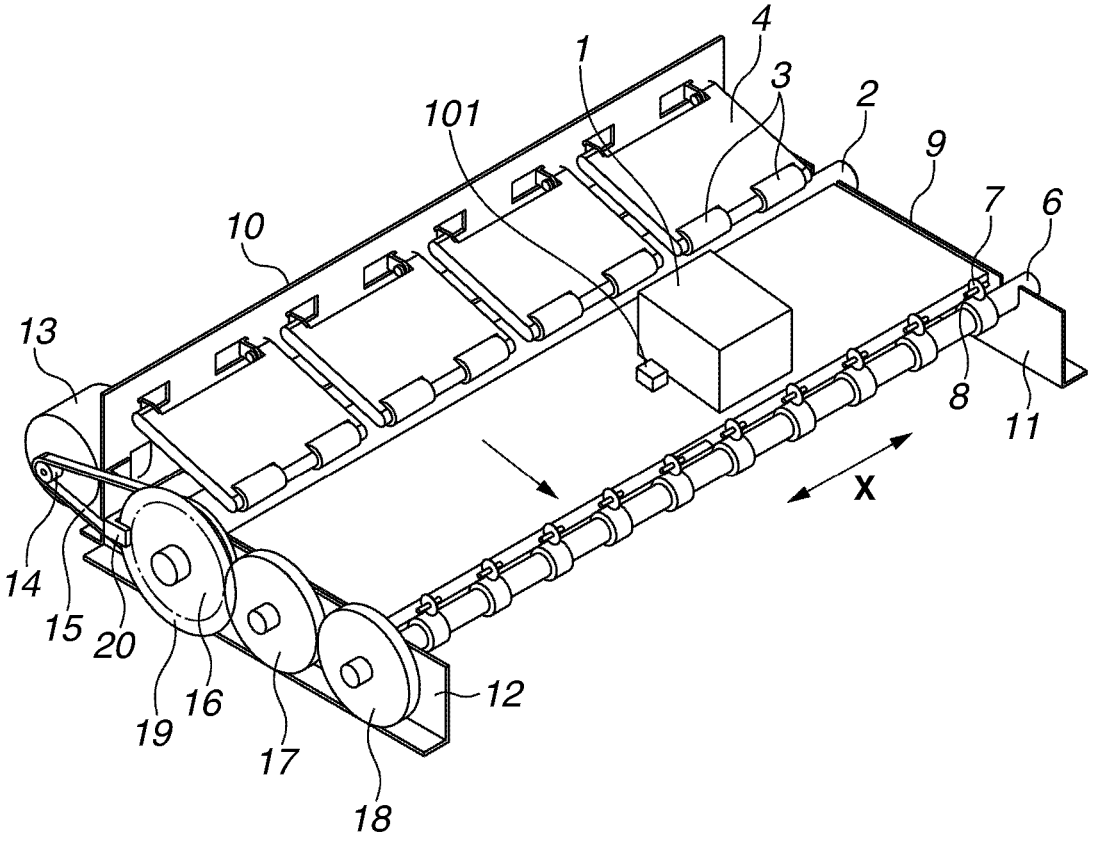
FIG. 2 is a perspective view illustrating the mechanism unit of the recording apparatus according to the first exemplary embodiment of the present invention.

A recording apparatus according to the present invention has an essential mechanism unit as described below. FIG. 1 is a perspective view illustrating the mechanism unit of the recording apparatus according to a first exemplary embodiment. FIG. 2 is a perspective view illustrating an essential portion of the mechanism unit of the recording apparatus according to the present exemplary embodiment. The recording apparatus includes a recording unit configured to perform recording on a recording medium (e.g., a sheet), a paper feeding unit configured to feed a recording medium, a paper conveying unit configured to convey the recording medium, and a control unit configured to control operations to be performed by each mechanism. Each unit is described in detail below.

(A) Recording Unit

The recording unit is configured to record an image on a recording medium with a recording head (not illustrated) mounted on a carriage 1. A platen 9 supports a lower surface of a recording medium when it is conveyed by the paper conveying unit. The recording head positioned at an upper position discharges ink in such a way as to form an image on an upper surface of the recording medium based on recording image information. The recording head and an ink tank 71 are mounted on the carriage 1. The ink tank 71 that supplies ink to the recording head, is movable in a scanning direction (i.e., the direction X illustrated in FIG. 1 or FIG. 2), which is intersectional with a conveyance direction. The carriage 1 records an image on a recording medium while moving in the scanning direction.

(B) Paper Feeding Unit

A paper feeding unit 21 is provided on an upstream side of the recording unit in the conveyance direction. The paper feeding unit 21 includes a paper conveying roller 22 that separates a recording medium from a bundle of recording media and supplies the separated recording medium to the paper conveying unit.

(C) Paper Conveying Unit

The paper conveying unit is provided on a downstream side of the paper feeding unit 21 in the conveyance direction. The paper conveying unit is configured to convey a recording medium accurately, when it is supplied from the paper feeding unit 21. A main mechanism of the paper conveying unit is attached to a main side plate 10, a right side plate 11, and a left side plate 12. The paper conveying unit includes a main conveyance roller 2 and a discharge roller 6 that cooperatively convey a recording medium. The main conveyance roller 2 includes a metallic shaft coated with a material containing ceramic particles.

The metallic shaft portion has both ends supported by the right side plate 11 and the left side plate 12. A plurality of pinch rollers 3 is supported by a pinch roller holder 4. The pinch roller holder 4 receives a moment generated by a pinch roller spring 31. The pinch roller holder 4 presses the pinch rollers 3 against the main conveyance roller 2 so that each pinch roller 3 can be driven by the main conveyance roller 2.

The driving force of a conveyance motor 13 (e.g., a DC motor) is transmitted to a pulley gear 16 fixed to the main conveyance roller 2 via a conveyance motor pulley 14 and a timing belt 15. The pulley gear 16 is coaxial with the main conveyance roller 2. Thus, the rotational force of the main conveyance roller 2 is given by the pulley gear 16. A chord wheel 19, having a plurality of slits provided at given pitches of 150 to 360 lpi, is directly connected to the main conveyance roller 2. The chord wheel 19 is coaxial with the main conveyance roller 2.

A conveyance roller encoder sensor 20 is fixed to the left side plate 12. The conveyance roller encoder sensor 20 can read the number of times or timing when the slits of the chord wheel 19 pass through the encoder sensor 20. Further, the chord wheel 19 includes a Z-phase slit, which is usable to detect the origin phase of the conveyance roller 2. The conveyance roller encoder sensor 20 can detect the origin phase position of the main conveyance roller 2 each time when the Z-phase slit passes through the encoder sensor 20.

The pulley gear 16 includes a pulley portion and a gear portion. The driving force of the gear portion is transmitted to a discharge roller gear 18 via an idler gear 17. The discharge roller 6 is driven by the discharge roller gear 18. The discharge roller 6 includes a metallic shaft and a rubber roller provided around the metallic shaft. A spur holder 43 is provided at a position opposed to the discharge roller 6. A plurality of spurs 7 is attached to the spur holder 43. Each spur 7 is rotatable around its axis and supported by a spur spring 8 (i.e., a rod-shaped coil spring). The spur spring 8 is supported at both ends thereof in such a manner that the spur spring 8 elastically deforms in a state in which the spurs 7 contact the discharge roller 6. The restoring force of the deformed spur spring 8 presses each spur 7 against the discharge roller 6.

In the present exemplary embodiment, the main conveyance roller 2 and the discharge roller 6 rotate at a speed ratio of 1:1. In addition, the pulley gear 16, the idler gear 17, and the discharge roller gear 18, which cooperatively constitute a driving transmission unit provided between the main conveyance roller 2 and the discharge roller 6, rotate at a speed ratio of 1:1:1. According to the above-mentioned configuration, a rotation period of the main conveyance roller 2, a rotation period of the discharge roller 6, and a rotation period of the transmission gear become equal to each other.

Therefore, when the main conveyance roller 2 rotates by an amount comparable to one period, each of the discharge roller 6 and the transmission gear rotates by an amount comparable to one period. More specifically, a conveyance amount error, which may occur due to eccentricity of a roller or transmission error of a gear and is variable depending on a rotational phase of each roller or gear, appears entirely during one complete revolution of the main conveyance roller 2. The present recording apparatus commonly manages rotational amounts of the main conveyance roller 2 and the discharge roller 6 based on the number of slits provided on the chord wheel 19 counted by the conveyance roller encoder sensor 20.

The present recording apparatus can form an image by repetitively performing an image recording operation with the recording head that moves in the scanning direction each time when the main conveyance roller 2 and the discharge roller 6 rotate 90 degrees. The 90-degree rotation is a referential rotation amount required to convey a recording medium to an ideal position. In the present invention, the rotational amount is corrected by correcting a periodic conveyance variation amount based on the phase position of a roller. The rotational amount can be managed by counting the number of slits provided on the chord wheel 19.

In the present exemplary embodiment, the main conveyance roller 2 is referred to as a first conveyance roller and the discharge roller 6 is referred to as a second conveyance roller. Further, a first conveyance state refers to a state in which only the first conveyance roller is operative to convey a recording medium. A second conveyance state refers to a state in which both the first conveyance roller and the second conveyance roller are cooperative to convey a recording medium. A third conveyance state refers to as a state in which only the second conveyance roller is operative to convey a recording medium.

Further, in the present recording apparatus, a periodic conveyance variation amount in the first conveyance state and a periodic conveyance variation amount in the third conveyance state are already known. A calculative periodic conveyance variation amount in the second conveyance state is calculated using a calculation formula, as described in detail below.

(D) Control System

Figure 3:
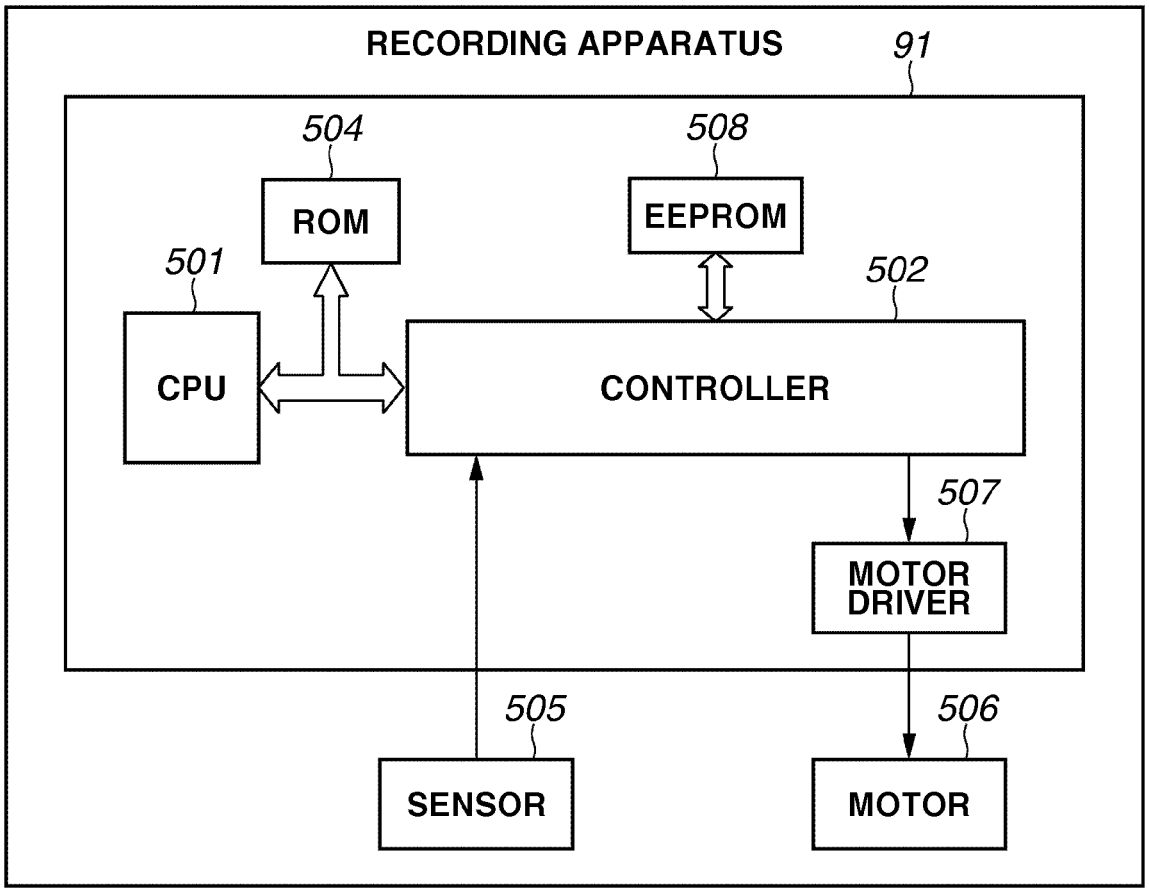
FIG. 3 is a block diagram illustrating a control configuration of the recording apparatus according to the first exemplary embodiment of the present invention.

FIG. 3 is a block diagram illustrating a control configuration of the recording apparatus according to the present exemplary embodiment. The control system controls various operations to be performed by respective mechanism units of the recording apparatus. A characteristic portion according to the present invention is described in detail below. The calculation formula described below is stored in a read only memory (ROM) 504. The above-mentioned periodic conveyance variation amount in the first conveyance state and the periodic conveyance variation amount in the third conveyance state are stored in an electrically erasable read-only memory (EEROM) 508 for each rotational phase interval. The CPU 501 calculates a calculative periodic conveyance variation amount (i.e., a calculative variation amount) according to the calculation formula stored in the ROM 504, based on two periodic conveyance variation amounts stored in the EEROM 508.

In a recording medium conveyance operation, the CPU 501 drives a motor 506 via a motor driver 507 to rotate and drive the main conveyance roller 2 and the discharge roller 6. In this case, the CPU 501 acquires origin phase information and rotational amount information from the conveyance roller encoder sensor 20, which belongs to a sensor 505, and performs a precise rotation driving operation for each of the main conveyance roller 2 and the discharge roller 6. Further, in this case, the CPU 501 determines a conveyance state of a recording medium based on information obtainable from an edge sensor that belongs to the sensor 505. The CPU 501 corrects rotation driving amounts for the main conveyance roller 2 and the discharge roller 6 based on a variation amount or a calculative variation amount that corresponds to each conveyance state.

Figure 6:
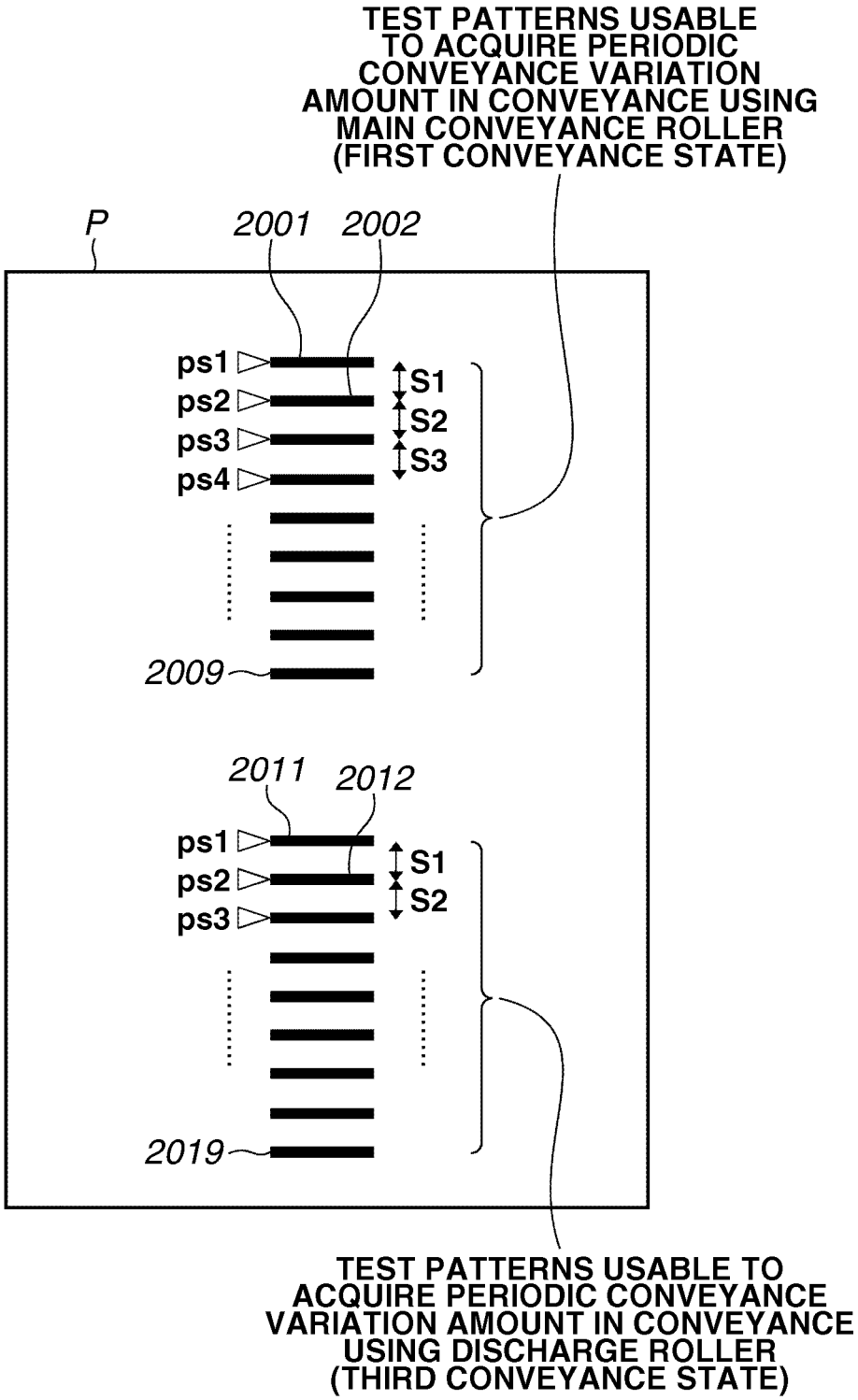
FIG. 6 illustrates test patterns that can be used to acquire a periodic conveyance variation amount in each conveyance state of the recording apparatus according to the first exemplary embodiment of the present invention.

Next, described in detail below with reference to FIG. 4, FIG. 5 (i.e., table 1), and FIG. 6 is a method capable of acquiring the periodic conveyance variation amounts in the first and third conveyance states. However, instead of using the method described below, it is feasible to acquire the periodic conveyance variation amount using a conventionally known technique. Further, the acquisition of the periodic conveyance variation amount can be performed at a factory or at a user-side before an actual printing operation is performed.

Figure 4:
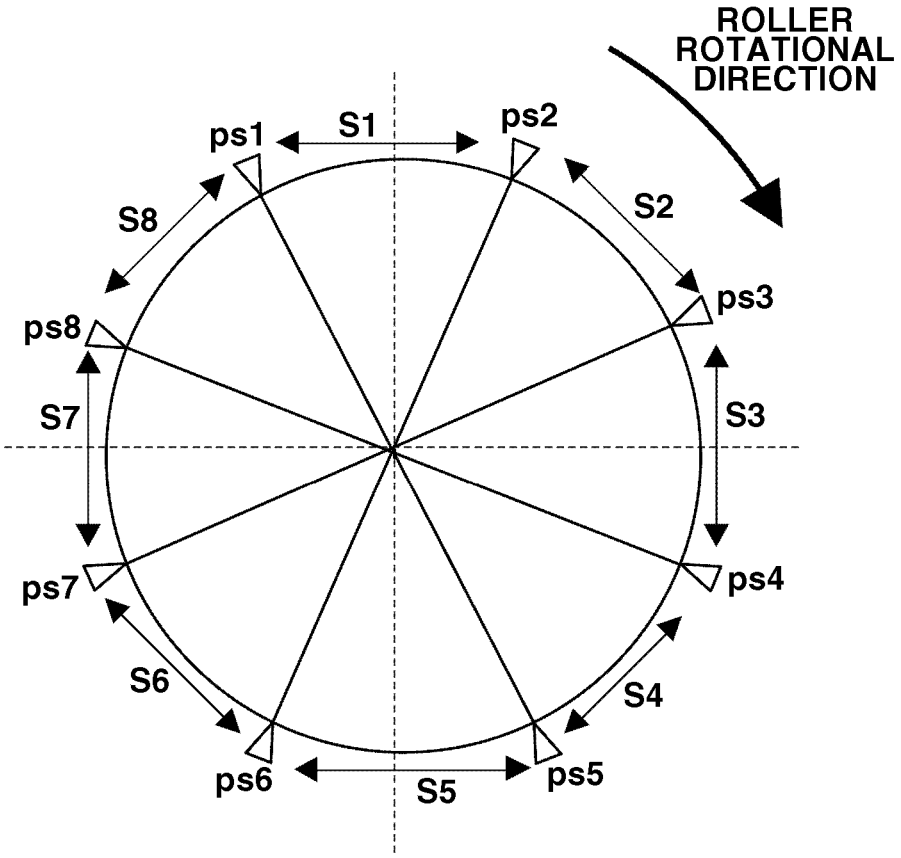
FIG. 4 schematically illustrates rotational phase intervals of a main conveyance roller and a discharge roller of the recording apparatus according to the first exemplary embodiment of the present invention.

FIG. 4 schematically illustrates eight rotational phase intervals S1 to S8, which can be formed by dividing the outer periphery of the roller into eight segments. In FIG. 4, ps1 to ps8 represent roller rotational phase positions at which the recording apparatus starts a paper conveyance operation in a test pattern recording operation described below. In the present exemplary embodiment, the outer periphery of each the main conveyance roller 2 and the discharge roller 6 is divided into eight segments. The recording apparatus stores periodic conveyance variation amounts for respective rotational phase intervals S1 to S8. The recording apparatus performs a periodic conveyance variation amount correction each time when the rotor rotates the referential rotation amount (=90 degrees), based on the stored periodic conveyance variation amounts.

The table 1 stores periodic conveyance variation amount D to be set for each rotational phase interval in each conveyance state.

The periodic conveyance variation amount D stored in the table 1 is set for each of eight rotational phase intervals S1 to S8, as information corresponding to the first and third conveyance states. Further, FIG. 6 illustrates an example of test patterns that are usable to acquire the periodic conveyance variation amount D relating to the first and third conveyance states.

First, the recording apparatus performs origin phase detection processing to identify the origin of the above-mentioned roller so that the roller rotational phase can be managed. In this state, the recording apparatus performs recording of the test patterns illustrated in FIG. 6.

In the recording of the above-mentioned test patterns, first, the recording apparatus performs recording of test patterns in the first conveyance state in which only the main conveyance roller 2 is operative to convey a paper. After a paper front end passes through the main conveyance roller 2, the recording apparatus performs a paper conveyance operation until the rotational phase of the main conveyance roller 2 reaches the position ps1. The recording apparatus records a first test pattern 2001 at the paper position ps1. After completing the pattern recording operation, the recording apparatus starts conveying the paper at the position ps1 and continues the paper conveyance operation until the roller rotational phase reaches the position ps2. Then, the recording apparatus records a second test pattern 2002.

A pattern clearance (i.e., a pitch) between the first test pattern 2001 and the second test pattern 2002 (for example, a distance between downstream edges of both patterns) corresponds to a conveyance amount of the paper during the rotational phase interval s1 between the positions ps1 and ps2. Similarly, after completing the second pattern recording operation, the recording apparatus starts conveying the paper at the position ps2 and continues the paper conveyance operation until the roller rotational phase reaches the position ps3. Then, the recording apparatus records a third test pattern 2003.

The recording apparatus repetitively performs the above-mentioned operation until the rotational phase of the main conveyance roller 2 returns to the position ps1. In the present exemplary embodiment, the recording apparatus records nine test patterns 2001 to 2009 by repetitively performing the above-mentioned operation.

Subsequently, the recording apparatus performs recording of test patterns in the third conveyance state in which only the discharge roller 6 is operative to convey a paper. After the paper rear end passes through a nip portion of the main conveyance roller 2 and the rotational phase of the discharge roller 6 reaches the position ps1, the recording apparatus records a test pattern 2011. Next, the recording apparatus starts conveying the paper at the position ps1 and continues the paper conveyance operation until the rotational phase reaches the position ps2. Then, the recording apparatus records a second test pattern 2012. The recording apparatus repetitively performs the above-mentioned operation until the rotational phase of the discharge roller 6 returns the position ps1. Through the above-mentioned operation, the recording apparatus records nine test patterns 2011 to 2019.

After completing the recording of all test patterns, the recording apparatus causes an optical sensor 101 mounted on the carriage 1 to measure pattern clearances of the test patterns 2001 to 2009 and the test patterns 2011 to 2019 while conveying the print completed paper again.

In the present exemplary embodiment, pattern clearances of the test patterns 2001 to 2009 correspond to conveyance amounts TLF1 to TLF8 during the rotational phase intervals S1 to S8 of the main conveyance roller 2, respectively. Similarly, pattern clearances of the test patterns 2011 to 2019 correspond to conveyance amounts TEJ1 to TEJ8 during the rotational phase intervals S1 to S8 of the discharge roller 6, respectively. Therefore, acquiring the conveyance amounts TLF1 to TLF8 during the rotational phase intervals S1 to S8 in the first conveyance state is feasible by measuring the pattern clearances of the test patterns 2001 to 2009. Similarly, acquiring the conveyance amounts TEJ1 to TEJ8 during the rotational phase intervals S1 to S8 in the third conveyance state is feasible by measuring the pattern clearances of the test patterns 2011 to 2019.

In the present exemplary embodiment, the recording apparatus records nine test patterns in each of the first and third conveyance states and acquires eight pattern clearances. In this case, the number of acquired pattern clearances is equal to the number of roller rotational phase intervals managed by the recording apparatus. However, for example, to improve the measurement accuracy, it is effective to set the number of pattern clearances to be greater than the number of roller rotational phase intervals.

Alternatively, to reduce the measurement time, it is effective to set the number of pattern clearances to be smaller than the number of roller rotational phase intervals. However, in a case where the number of pattern clearances is different from the number of roller rotational phase intervals to be managed, it is necessary to calculate conveyance amounts during respective rotational phase intervals by performing measurement value interpolation processing.

Next, the recording apparatus calculates the periodic conveyance variation amount D based on the above-mentioned conveyance amounts during respective rotational phase intervals. In the present exemplary embodiment, the periodic conveyance variation amount D is a value indicating a conveyance deviation amount relative to an average conveyance amount Z (as another example, a conveyance amount during each rotational phase interval can be designated as the periodic conveyance variation amount). First, the recording apparatus calculates the average conveyance amount Z. An average conveyance amount in each conveyance state is equal to an average value Z obtainable based on conveyance amounts during respective rotational phase intervals.

More specifically, the recording apparatus obtains a sum of the conveyance amounts TLF1 to TLF8 during respective rotational phase intervals S1 to S8 and calculates an average conveyance amount ZLF of the main conveyance roller 2 by dividing the obtained sum by 8. Similarly, the recording apparatus obtains a sum of the conveyance amounts TEJ1 to TEJ8 during respective rotational phase intervals S1 to S8 and calculates an average conveyance amount ZEJ of the discharge roller 6 by dividing the obtained sum by 8.

After calculating the average conveyance amount as mentioned above, the recording apparatus acquires periodic conveyance variation amounts by subtracting the above-mentioned average conveyance amount from the conveyance amount during each rotational phase interval in each conveyance state (i.e., DLFn=TLFn−ZLF and DEJn=TEJn−ZEJ, in which "n" is an integer from 1 to 8). The recording apparatus stores the acquired variation amounts DLF1 to DLF8 and DEJ1 to DEJ8 in the table 1.

Through the above-mentioned sequential operations, the recording apparatus can acquire the periodic conveyance variation amount D for each rotational phase interval in each of the first and third conveyance states.

Next, described below is a calculation formula usable to calculate the remaining one calculative periodic conveyance variation amount based on two known periodic conveyance variation amounts. In the present exemplary embodiment, the periodic conveyance variation amounts in the first conveyance state and the third conveyance state are stored in the EEPROM 508 and are already known. Therefore, the recording apparatus calculates a periodic conveyance variation amount in the second conveyance state based on the conveyance period conveyance amounts in the first and third conveyance states.

First, a method capable of simply deriving the above-mentioned calculation formula, in which a conveyance amount relationship (not the periodic conveyance variation amount itself) is taken into consideration, is described in detail below. More specifically, the method includes deriving a calculation formula usable to calculate a conveyance amount in the second conveyance state based on conveyance amounts in the first and third conveyance states.

In the present exemplary embodiment, βLF represents the conveyance amount in the first conveyance state, and βEJ represents the conveyance amount in third conveyance state. Further, βLFEJ represents the conveyance amount in the second conveyance state.

As mentioned above, the second conveyance state is a conveyance state relevant to the conveyance amounts of both the main conveyance roller and the discharge roller. The conveyance amount βLF of the main conveyance roller itself is independent from the conveyance amount βEJ of the discharge roller itself. The conveyance amount in βLFEJ is not equal to the conveyance amount βLF or the conveyance amount βEJ. More specifically, in the second conveyance state, a conveyance amount adjustment is performed between the main conveyance roller and the discharge roller. The conveyance amount βLFEJ is determined as a value different from the conveyance amount βLF or the conveyance amount βEJ.

It is generally known that the conveyance amount of a recording medium tends to be smaller due to slippage when a load acts on the recording medium. Further, the amount of slippage occurring under application of load can be experimentally obtained by actually measuring the conveyance amount of a recording medium while applying an already known weight to the recording medium. For example, a graph illustrated in FIG. 13 can be obtained through such an experiment. As mentioned above, when the applied load increases, the amount of slippage increases and the conveyance amount decreases.

Figure 13:
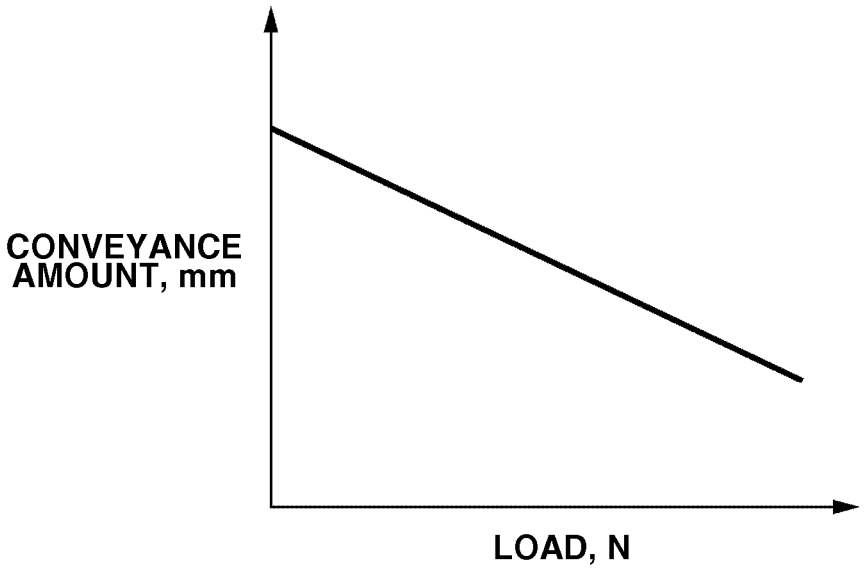
FIG. 13 is a graph illustrating a relationship between load and conveyance amount in a recording medium conveyance operation.

The gradient of a line illustrated in FIG. 13 is referred to as conveyance characterization factor α. The conveyance characterization factor α is a value indicating a slip amount per unit load. More specifically, a formula {(conveyance amount under applied load)−(conveyance amount when no load is applied)}/(magnitude of load) defines the coefficient α (mm/N in this case). The coefficient α is a negative value. The conveyance characterization factor α is experimentally obtainable for each of the conveyance roller and the discharge roller. The coefficient values obtained for the conveyance roller and the discharge roller are referred to as αLF and αEJ, respectively.

If it is presumed that the force acting between double shafts of the main conveyance roller and the discharge roller is a factor that determines the conveyance amount βLFEJ, the conveyance amount of a recording medium on each roller can be written using the following formulae (1) and (2). In the following formula (1), FLF represents a load that acts on the main conveyance roller. In the following formula (2), FEJ represents a load that acts on the discharge roller.

$$\beta LFEJ=\alpha LF\cdot FLF+\beta LF \tag{1}$$

$$\beta LFEJ=\alpha EJ\cdot FEJ+\beta EJ \tag{2}$$

In the formulae (1) and (2), two loads FLF and FEJ are in a relationship of FLF=−FEJ as understood from the law of action and reaction. If the formulae (1) and (2) are rewritten considering the relationship of FLF=−FEJ, the conveyance amount βLFEJ can be defined using the following formula (3).

$$\beta LFEJ=((1/\pi LF)/((1/\pi LF)+(1/\pi EJ)))\cdot\beta LF+((1/\alpha LF)/((1/\alpha LF)+(1/\alpha EJ)))\cdot\beta EJ \tag{3}$$

According to the formula (3) that can be derived in the above-mentioned manner, it is understood that the conveyance amount βLFEJ is a weighted average of βLF and βEJ that can be expressed using weighting coefficients 1/πLF and 1/αEJ. The conveyance characterization factor α is a numerical value that represents the slip amount per unit load. Therefore, a reciprocal 1/α is a numerical value that indicates the robustness against slippage under application of load. In the present exemplary embodiment, the robustness against slippage under application of load (i.e., 1/α) is referred to as conveyance robustness. When the robustness against slippage is expressed by γ (=1/α), the formula (3) can be modified in the following manner.

$$\beta LFEJ=(\gamma LF/(\gamma LF+\gamma EJ))\cdot\beta LF+(\gamma EJ/(\gamma LF+\gamma EJ))\cdot\beta EJ \tag{4}$$

Accordingly, the conveyance amount βLFEJ in the conveyance of a recording medium using a plurality of rollers can be calculated as a weighted average of the conveyance amounts βLF and βEJ of respective rollers using the conveyance robustness (i.e., robustness against slippage) of each roller.

Considering the above-mentioned relationship, the periodic conveyance variation amount can be evaluated in the following manner. The periodic conveyance variation amount is a value indicating a conveyance error amount compared to the average conveyance amount. Accordingly, the conveyance amount β is equal to a sum of the average conveyance amount and the periodic conveyance variation amount. When Z represents an average conveyance amount of each conveyance state, the formula (3) can be rewritten using the following formulae (5) and (6).

$$\begin{aligned} DLFEJn+ZLFEJ = {} & ((1/\alpha LF)/((1/\alpha LF)+(1/\alpha EJ)))\cdot DLFn+ \\ & ((1/\alpha LF)/((1/\alpha LF)+(1/\alpha EJ)))\cdot DEJn+ \\ & ((1/\alpha LF)/((1/\alpha LF)+(1/\alpha EJ)))\cdot ZLF+ \\ & ((1/\alpha LF)/((1/\alpha LF)+(1/\alpha EJ)))\cdot ZEJ \end{aligned} \tag{5}$$

$$\begin{aligned} DLFEJn+ZLFEJ = {} & (\gamma LF/(\gamma LF+\gamma EJ))\cdot DLFn+ \\ & (\gamma EJ/(\gamma LF+\gamma EJ))\cdot DEJn+ \\ & (\gamma LF/(\gamma LF+\gamma EJ))\cdot ZLF+ \\ & (\gamma EJ/(\gamma LF+\gamma EJ))\cdot ZEJ \end{aligned} \tag{6}$$

In the formulae (5) and (6), each suffix "n" of the periodic conveyance variation amount D represents an arbitrary rotational phase. In the formulae (5) and (6), the second terms in both sides relate to the average conveyance amount that does not depend on the rotational phase. The first terms in both sides relate to the periodic conveyance variation amount (more specifically, the amount suffixed with "n"). When only the first term (i.e., the element variable depending on the rotational phase) is taken out from both sides, the amount DLFEJn can be expressed using the following formula (7).

$$DLFEJn=(\gamma LF/(\gamma LF+\gamma EJ))\cdot DLFn+(\gamma EJ/(\gamma LF+\gamma EJ))\cdot DEJn \tag{7}$$

Thus, it is understood that a calculation formula for calculating a calculative periodic conveyance variation amount DLFEJn is obtainable by replacing the conveyance amount β by the periodic conveyance variation amount D in the formula (2). Accordingly, it is understood that the formula (5) is usable to calculate the periodic conveyance variation amount for each rotational phase interval.

Figure 7:
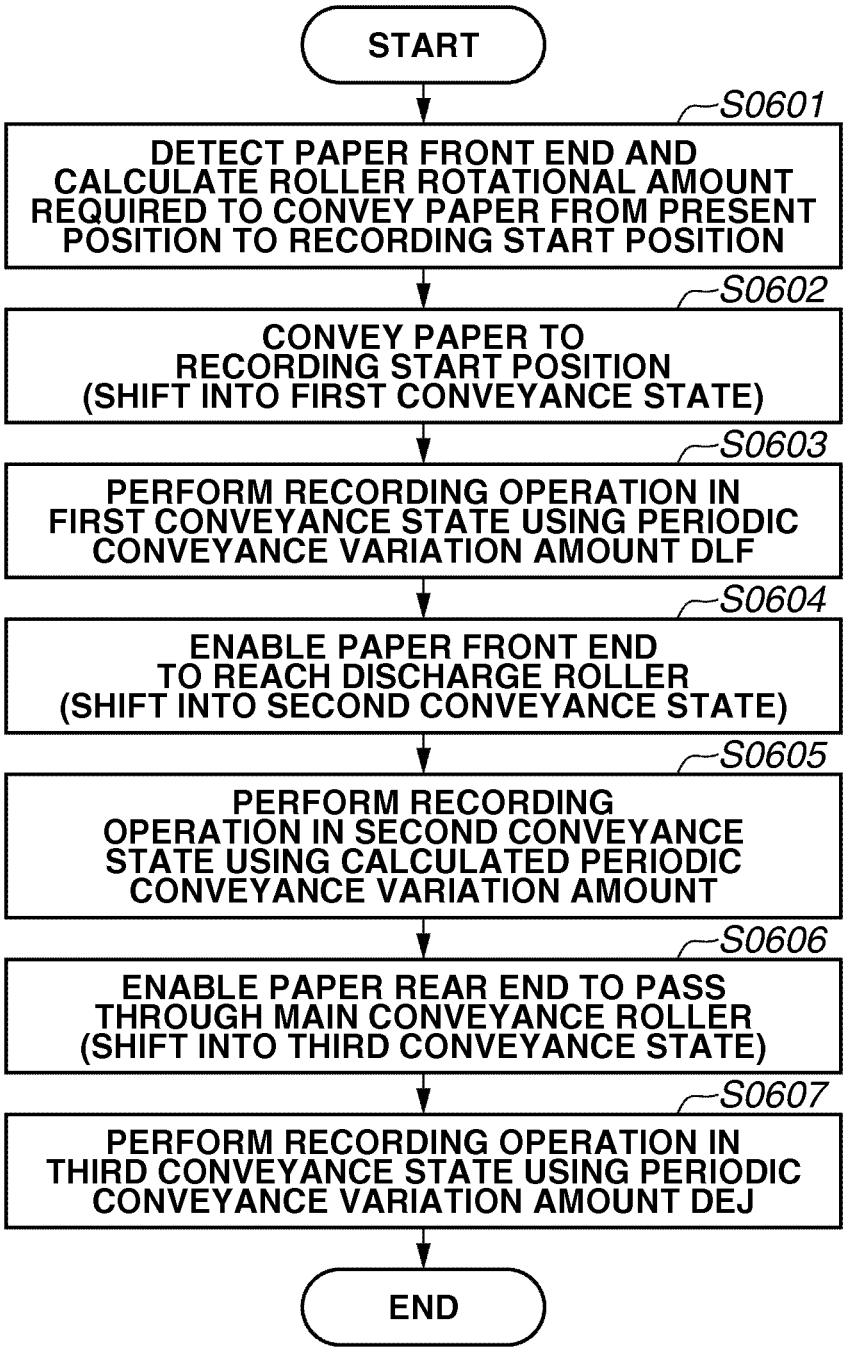
FIG. 7 is a flowchart illustrating periodic conveyance variation correction control in a recording operation that can be performed by the recording apparatus according to the first exemplary embodiment of the present invention.

A method for correcting the periodic conveyance variation amount in each conveyance state while performing an actual recording operation is described in detail below with reference to FIG. 7. FIG. 7 is a flowchart illustrating correction control processing that can be performed in an actual recording operation.

First, if the recording apparatus receives a signal instructing an image recording operation, the paper feeding unit 21 supplies a paper. The paper approaches to the edge sensor positioned on an upstream side of the main conveyance roller 2. In this case, in step S0601 of the flowchart illustrated in FIG. 7, the edge sensor detects the position of a paper front end. The recording apparatus calculates a roller rotational amount required to convey the paper from the present position to an actual recording start position.

Next, in step S0602, the recording apparatus performs a paper conveyance operation based on the calculated roller rotational amount in such a way as to locate the paper at the recording start position. In this case, the paper front end passes through the main conveyance roller 2. At this moment, the operational state of the recording apparatus shifts into the first conveyance state.

Next, in step S0603, the recording apparatus performs a recording operation in an area adjacent to the paper front end. The recording operation to be performed in step S0603 includes causing the carriage 1 to move the recording head and causing the main conveyance roller 2 to convey the paper, which is repetitively performed. In the first conveyance state, the recording apparatus performs a rotational amount correction in the following manner using the periodic conveyance variation amount DLF. First, the recording apparatus detects the present phase position based on information about the counted number of slits that is measurable by the conveyance roller encoder sensor 20.

Next, the recording apparatus performs a periodic conveyance variation amount correction in the first conveyance state by adjusting the roller rotational amount based on an addition value of periodic conveyance variation amounts stored during an interval between the present phase and a scheduled stop phase. More specifically, it is desired that the addition value of periodic conveyance variation amounts from a rotation start phase to the scheduled stop phase is equal to 0 (i.e., the conveyance is ideal) when the conveyance operation is stopped.

Therefore, the recording apparatus corrects a deviation amount caused by the periodic variations based on a roller rotational amount correction. In the present exemplary embodiment, the referential rotation amount is 90 degrees (i.e., $\pi/2$). Therefore, for example, if it is presumed that the present phase is the position p3 illustrated in FIG. 4, the addition value of periodic conveyance variation amounts is equal to (DLF3+DLF4). If $\theta$ (rad) represents the roller rotational amount, a rotational amount to be corrected can be calculated using the following formula (8). Accordingly, in this case, the recording apparatus can rotate the main conveyance roller 2 by an angle defined by the following formula (9) based on the above-mentioned counted number of slits.

$$\theta=(DLF3+DLF4)\cdot 2\pi/L \tag{8}$$

$$\pi/2-(DLF3+DLF4)\cdot 2\pi/L \tag{9}$$

In general, when the present phase is phase pn, a rotational angle $\theta n$ to be corrected can be calculated using the following formula (10).

$$\theta n=(DLFn+DLF(n+1))\cdot 2\pi/L \tag{10}$$

Accordingly, the recording apparatus can rotate the main conveyance roller 2 by an angle defined by the following formula (11) in such a way as to equalize the conveyance amount during the $\pi/2$ rotation with an ideal conveyance amount.

$$\pi/2-(DLFn+DLF(n+1))\cdot 2\pi/L \tag{11}$$

In the above-mentioned formulae, L is the ideal conveyance amount of a recording medium during one complete revolution of the roller. In a case where the rotation start phase or the scheduled stop phase is present in a phase interval in which periodic conveyance variation amounts are stored, a conventionally known method for correcting the phase section based on a ratio is employable to improve the correction accuracy.

Further, although L represents the ideal conveyance amount in the present exemplary embodiment, L can be an actually measured roller conveyance amount. The recording apparatus continuously performs the above-mentioned first conveyance state correction until the paper front end almost reaches the discharge roller 6. Subsequently, in step S0604, the recording apparatus enables the paper front end to reach the discharge roller 6 and shifts the operational state thereof into the second conveyance state.

If the recording apparatus completes the sequential processing in steps S0601 to S0604, then in step S0605, the recording apparatus switches the conveyance variation amount from the presently used one (i.e., the periodic conveyance variation amount DLF) to a calculative periodic conveyance variation amount. As mentioned above, the recording apparatus can calculate the calculative periodic conveyance variation amount based on the periodic conveyance variation amount DLF in the first conveyance state, the conveyance variation amount DEJ in the second conveyance state, and phase positions of two rollers, with reference to the formula (2).

Further, in step 0605, the recording apparatus detects the present phase position based on information about the counted number of slits that is measurable by the conveyance roller encoder sensor 20. In this step, the recording apparatus performs a recording operation in the second conveyance state according to the calculative periodic conveyance variation amount while adjusting the roller rotational amount.

The recording apparatus continuously performs the above-mentioned correction based on the calculative periodic conveyance variation amount until the paper rear end almost passes through the main conveyance roller 2. The recording apparatus can calculate the above-mentioned timing, i.e., the time when the paper rear end passes through the main conveyance roller 2, based on the detected paper front-end position and the paper length included in information about an image to be recorded. Further, it is also useful to calculate the above-mentioned timing based on a paper rear-end position newly detected by the edge sensor.

Next, in step S0606, the recording apparatus enables the paper rear end to pass through the main conveyance roller 2 and shifts the operational state thereof into the third conveyance state.

Then, in step S0607, the recording apparatus switches the conveyance variation amount from the presently used one to the periodic conveyance variation amount DEJ. Subsequently, similar to the above-mentioned correction method, the recording apparatus perform a recording operation in an area adjacent to the paper rear end while correcting the conveyance amount based on the periodic conveyance variation amount DEJ.

The recording apparatus can complete the image recording operation in the entire area of the paper through the above-mentioned processing. Subsequently, the discharge roller 6 discharges the image recorded paper to a paper output tray. The recording apparatus terminates the image recording operation.

In the present exemplary embodiment, the recording apparatus calculates a calculative periodic conveyance variation amount in the second conveyance state and adjusts the roller rotational amount in a recording operation. It is also useful to calculate the calculative periodic conveyance variation amount beforehand and store the calculative periodic conveyance variation amount in the recording apparatus before starting a recording operation, and then adjust the rotational amount according to the stored calculative periodic conveyance variation amount.

Further, in the present exemplary embodiment, it is presumed that the periodic conveyance variation amounts in the first and third conveyance states are already known. However, the present exemplary embodiment is not limited to the above-mentioned example. It is only required that periodic conveyance variation amounts in any two of three conveyance states are known.

Further, in the present exemplary embodiment, the recording apparatus calculates the periodic conveyance variation amount in the second conveyance state based on the conveyance period conveyance amounts in the first and third conveyance states. However, it is also useful to acquire the periodic conveyance variation amount beforehand by performing an actual measurement. However, in this case, the actual measurement cost may increase.

Further, in the present exemplary embodiment, it is feasible to enhance the effect of improving the image quality by performing the above-mentioned processing together with an ordinary conveyance correction for suppressing a conveyance deviation derived from a difference in conveyance roller diameter or a slip caused by a back tension, which is different from the above-mentioned periodic variation.

In the present exemplary embodiment, the recording apparatus corrects the roller rotational amount based on the periodic conveyance variation amount (which is categorized as the conveyance amount). However, it is also useful to use a reciprocal thereof as a correction value in the calculation.

As mentioned above, according to the present exemplary embodiment, the recording apparatus can correct the periodic conveyance variation amount in each of different conveyance states of a conveyance roller. Therefore, it is feasible to improve the image quality.

The conveyance variation amount obtained in the above-mentioned exemplary embodiment is a deviation from an average conveyance amount. However, it is also useful to calculate a deviation from an ideal target conveyance amount.

In the first exemplary embodiment, the difference or any change in the type or the size of a recording medium is not taken into consideration. In a second exemplary embodiment, the recording apparatus can perform a periodic conveyance variation amount correction appropriately even when the recording medium to be used in a recording operation changes in the type or the size. The present exemplary embodiment is similar to the first exemplary embodiment except that a calculative periodic conveyance variation amount is calculated considering the type or the size of the recording medium. The rest of the configuration according to the present exemplary embodiment is similar to that described in the first exemplary embodiment. Therefore, redundant description thereof will be avoided.

As mentioned above, the periodical variation in the conveyance amount of a conveyance roller is caused by the fluctuation of a driving transmission unit. Accordingly, even when the type or the size of a recording medium changes, the periodic conveyance variation amount does not vary as long as the recording medium is conveyed by a single conveyance roller. On the other hand, it is known that the conveyance characterization factor $\alpha$ (i.e., a value indicating a slip amount per unit load) is variable depending on the type or the size of the recording medium. Accordingly, it is understood from the formula (2) that the periodic conveyance variation amount is variable depending on the type or the size in a state where a plurality of conveyance rollers is operative to convey a recording medium.

In the present exemplary embodiment, a table 2 illustrated in FIG. 8 is employed to store the conveyance characterization factor $\alpha$ classified beforehand according to the type and the size of each recording medium.

In the rotation correction in the second conveyance state during a recording operation (see step S0605 in FIG. 7), the recording apparatus selects an appropriate conveyance characterization factor $\alpha$ with reference to the type and the size of each recording medium and calculates a calculative periodic conveyance variation amount based on the selected conveyance characterization factor $\alpha$. In the present exemplary embodiment, the number of recording medium types that can be processed by the recording apparatus is three (i.e., A, B, and C). The number of recording medium sizes that can be processed by the recording apparatus is three (i.e., large, medium, and small).

As mentioned above, according to the present exemplary embodiment, the recording apparatus can correct the periodic conveyance variation amount according to the type or the size of each recording medium in each conveyance state in which a different conveyance roller or a different combination of conveyance rollers is used. Thus, it is feasible to improve the image quality.

In the first and second exemplary embodiments, the first conveyance roller and the second conveyance roller rotate at a speed ratio of 1:1. However, the present invention is not limited to the above-mentioned roller speed ratio of 1:1 and is applicable to any other arbitrary speed ratio of m:n. Therefore, in a third exemplary embodiment, the speed ratio of two conveyance rollers is set to 2:1, as described below. Constituent elements other than the speed ratio are similar to those described in the first exemplary embodiment and therefore redundant description thereof will be avoided.

When $\theta LF$ represents a rotational amount of the first conveyance roller and $\theta EJ$ represents a rotational amount of the second conveyance roller, a relationship $\theta EJ=2\theta LF$ is satisfied because the speed ratio is 2:1. The conveyance roller encoder sensor 20, which detects the rotational amounts of two conveyance rollers, is provided on the first conveyance roller. Therefore, it is necessary to adjust the rotational amount $\theta EJ$ of the second conveyance roller based on the rotational amount $\theta LF$ of the first conveyance roller.

The periodical variation in the conveyance amount of a conveyance roller is a variation amount that is circulated during one complete revolution of the conveyance roller. Therefore, periodic conveyance variation amounts ELF and EEJ of two conveyance rollers are stored for respective phases while each roller rotates 360 degrees. A table 3 illustrated in FIG. 9 is a table that stores the periodic conveyance variation amounts ELF and EEJ.

As illustrated in table 3, the periodic conveyance variation amounts of the second conveyance roller stored based on the criterion of the first conveyance roller are half-period data compared to those of the first conveyance roller. Even when the rotation period of one roller is different from the rotation period of the other roller, a calculation method similar to that used to correct the rotational amount is usable if the rotation start phase and the scheduled stop phase are known in an actual printing operation. Therefore, the periodic conveyance variation amount correction method described in the first exemplary embodiment is usable to correct the rotational amount.

Using only one sensor provided on the first conveyance roller may not be desired to manage the origin phase of each of the first and second conveyance rollers, if the speed ratio is inappropriate. In such a case, it is useful to provide the sensor on each of two rollers.

In the first to third exemplary embodiments, the recording apparatus uses two conveyance rollers to convey a recording medium. However, the number of rollers is not limited to two. The present invention is applicable to another recording apparatus that uses three or more conveyance rollers. Therefore, in a fourth exemplary embodiment, three conveyance rollers are used to convey a recording medium, as described below.

In the present exemplary embodiment, it is presumed that the periodic conveyance variation amount in a conveyance operation of a recording medium performed by each roller (i.e., a single shaft) is already known for each of three conveyance rollers. The recording apparatus calculates a periodic conveyance variation amount of another conveyance state, if it is present in a recording medium conveyance operation, according to a calculation formula, similar to the first exemplary embodiment.

Figure 10:
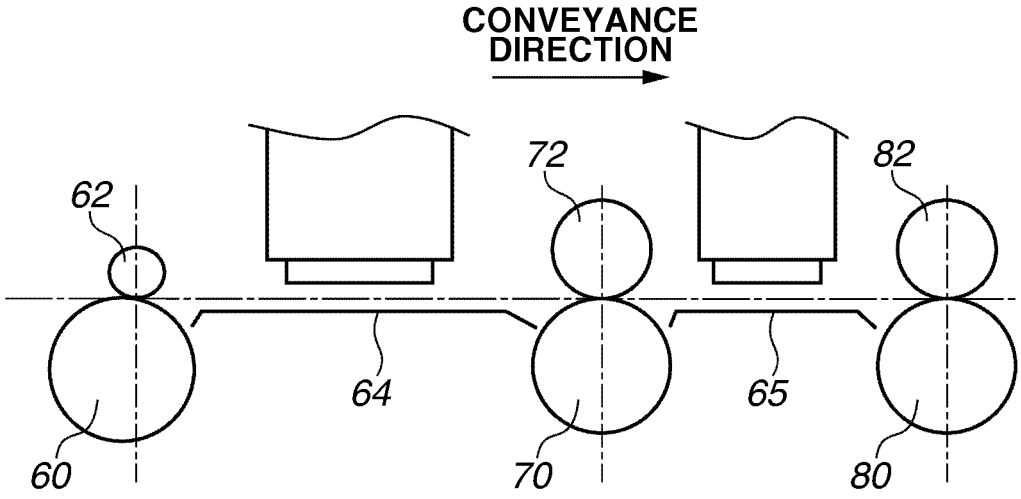
FIG. 10 is a cross-sectional view illustrating details of a conveyance mechanism of the recording apparatus, which includes a paper conveying unit, according to a fourth exemplary embodiment of the present invention.

FIG. 10 is a cross-sectional view schematically illustrating a conveyance mechanism including a paper conveying unit in a recording apparatus according to the present exemplary embodiment. In the present exemplary embodiment, the recording apparatus conveys a recording medium using three rollers of an upstream roller 60, an intermediate roller 70, and a downstream roller 80. Respective rollers rotate at a speed ratio of 1:1:1. The recording apparatus starts a conveyance operation when a supplied recording medium is guided by a guide member (not illustrated) in such a way as to approach an upstream roller pair constituted by the upstream roller 60 and a pinch roller 62.

The recording medium is conveyed by the upstream roller pair in such a way as to approach an intermediate roller pair constituted by the intermediate roller 70 and an intermediate spur 72. Then, the recording medium is conveyed by the intermediate roller pair in such a way as to approach a downstream roller pair constituted by the downstream roller 80 and a downstream spur 82.

While the upstream roller 60, the intermediate roller 70, and the downstream roller 80 cooperatively perform the conveyance operation as mentioned above, two recording heads disposed between three rollers perform an image recording operation to form an image on the recording medium. When the image recording operation completes, the downstream roller 80 discharges the recording medium to a paper output tray (not illustrated).

The recording apparatus performs the image recording operation while changing the conveyance state of the recording medium. In the present exemplary embodiment, a conveyance state CA refers to a state in which only the upstream roller 60 is operative to convey the recording medium. A conveyance state CB refers to a state in which only the intermediate roller 70 is operative to convey the recording medium. A conveyance state CC refers to a state in which only the downstream roller 80 is operative to convey the recording medium.

Further, a conveyance state CAB refers to a state in which the upstream roller 60 and the intermediate roller 70 (i.e., double shafts) are operative to convey the recording medium. A conveyance state CBC refers to a state in which the intermediate roller 70 and the downstream roller 80 (i.e., another double shafts) are operative to convey the recording medium. Further, a conveyance state CABC refers to a state in which all of the upstream roller 60, the intermediate roller 70, and the downstream roller 80 (i.e., triple shafts) are operative to convey the recording medium.

In the present exemplary embodiment, the recording apparatus performs the image recording operation through the above-mentioned six conveyance states at most, although it depends on the length of the recording medium in the conveyance direction.

A table 4 illustrated in FIG. 11 is a table that stores periodic conveyance variation amounts to be set for respective rotational phase intervals in each conveyance state according to the present exemplary embodiment.

The table 4 stores periodic conveyance variation amounts TA1 to TA8 dedicated to the conveyance state CA, periodic conveyance variation amounts TB1 to TB8 dedicated to the conveyance state CB, and periodic conveyance variation amounts CA1 to CA8 dedicated to the conveyance state CC. Hereinafter, the periodic conveyance variation amount in each conveyance state is expressed without using a suffix that indicates the phase (e.g., TA). A table 5 illustrated in FIG. 12 is a table that stores the conveyance characterization factor $\alpha$ that is required to calculate the periodic conveyance variation amount in each conveyance state.

As mentioned above, the conveyance characterization factor $\alpha$ is a value indicating a slip amount per unit load for each conveyance roller. Therefore, the conveyance characterization factor $\alpha$ is set for each of the conveyance states CA, CB, and CC in which only one roller (i.e., single shaft) is operative to convey a recording medium.

A method for calculating a periodic conveyance variation amount in a conveyance state other than the already known states CA, CB, and CC is described below. The basic calculation principle is similar to that having been described previously. More specifically, the calculation is based on the premise that a cooperative conveyance amount by a plurality of conveyance units is a weighted average of the conveyance amounts by respective conveyance units that can be expressed using weighting coefficients of respective conveyance units that can indicate the robustness against slippage under application of load. In the first exemplary embodiment, two rollers (i.e., double shafts) contribute to the conveyance. However, the above-mentioned principle is not limited to the double shafts and is applicable to the conveyance using three or more rollers.

In the present exemplary embodiment, to derive the above-mentioned calculation formulae, a relationship between conveyance amounts (not the periodic conveyance variation amounts) is taken into consideration similar to the first exemplary embodiment. If $\beta$ represents the conveyance amount in each conveyance state, conveyance amounts $\beta AB$ and $\beta BC$ in the conveyance states CAB and CBC (namely, the conveyance amounts in the conveyance state using double shafts) can be described using the following formulae (12) and (13), similar to the formula (3) described in the first exemplary embodiment.

$$\beta AB=((1/\alpha A)/((1/\alpha A)+(1/\alpha B)))\cdot\beta A+((1/\alpha B)/((1/\alpha A)+(1/\alpha B)))\cdot\beta B \quad (12)$$

$$\beta BC=((1/\alpha B)/((1/\alpha B)+(1/\alpha C)))\cdot\beta B+((1/\alpha C)/((1/\alpha B)+(1/\alpha C)))\cdot\beta C \quad (13)$$

Further, conveyance amount $\beta ABC$ in the conveyance state CABC (namely, the conveyance amount in the conveyance state using triple shafts) can be described using the following formula (14) based on the similar principle. More specifically, the conveyance amount $\beta ABC$ can be expressed as a weighted average of conveyance amounts $\beta A$, $\beta B$, and $\beta C$ that can be expressed using weighting coefficients that can indicate conveyance robustness $1/\alpha A$, $1/\alpha B$, and $1/\alpha C$.

$$\beta ABC=((1/\alpha A)\cdot\beta A+(1/\alpha B)\cdot\beta B+(1/\alpha C)\cdot\beta C)/((1/\alpha A)+(1/\alpha B)+(1/\alpha C)) \quad (14)$$

Accordingly, it is apparent from the above-mentioned formulae (12), (13), and (14) that conveyance amounts in all of six conveyance states can be calculated using conveyance amounts in three conveyance states. According to the principle of the calculation formula described in the first exemplary embodiment, the conveyance amount β can be replaced by a periodic conveyance variation amount T. More specifically, periodic conveyance variation amounts in three conveyance states TA, TB, and TC are already known. Therefore, it is feasible to calculate periodic conveyance variation amounts of all of six conveyance states using the formulae (12), (13), and (14).

As mentioned above, similar to the above-mentioned exemplary embodiments, it is feasible to perform periodic conveyance variation amount correction for each conveyance state using the calculated periodic conveyance variation amounts and periodic conveyance variation amounts stored beforehand.

In a case where the length of a paper to be used in an actual measurement of the periodic conveyance variation amount is longer than the distance between the upstream roller 60 and the downstream roller 80, the conveyance state CB in which only the intermediate roller 70 is operative is not present. Even in such a case, it is feasible to obtain periodic conveyance variation amounts of all conveyance states based on actual measurement of periodic conveyance variation amounts in three conveyance states, using the following combinations.

For example, in a case where TA, TC, and TAB are obtained in the actual measurement, TB can be calculated using the formula (5). Subsequently, the calculated TB can be used to obtain periodic conveyance variation amounts in all conveyance states by solving the formulae (4) and (5). Further, in a case where TA, TAB, and TABC are obtained in the actual measurement, it is feasible to obtain the periodic conveyance variation amounts in all conveyance states based on a similar principle. Accordingly, in a case where three rollers are used in the conveyance of a recording medium, it is feasible to obtain periodic conveyance variation amounts of all of the remaining conveyance states based on an actual measurement of periodic conveyance variation amounts of appropriately selected three conveyance states.

In the present exemplary embodiment, the number of rollers to be used in the conveyance operation is three. However, even in a case where four or more rollers are used in the conveyance operation, it is feasible to obtain periodic conveyance variation amounts of all conveyance states based on an actual measurement of periodic conveyance variation amounts of a predetermined number of conveyance states that is comparable to the number of used rollers. For example, in a case where the number of rollers used in the conveyance of a recording medium is "n", the number of conveyance states is $\{n(n+1)/2\}$ at most.

In this case, the number of conveyance states to be actually measured is "n" because the periodic conveyance variation amount in a conveyance state in which a plurality of rollers is cooperative to convey the recording medium can be obtained using a calculation formula that includes periodic conveyance variation amounts of respective rollers (i.e., respective single shafts) together with conveyance characterization factors. Therefore, it is feasible to calculate all periodic conveyance variation amounts when the periodic conveyance variation amount of each roller (i.e., each single shaft) is known. Further, even in a case where the periodic conveyance variation amount of an arbitrary roller (i.e., a single shaft) is not yet actually measured, it is feasible to obtain a conversion value based on the periodic conveyance variation amount in a conveyance state relating to the roller.

In each of the above-mentioned exemplary embodiments, the recording apparatus obtains a variation in the conveyance amount for each of the phase sections S1 to S8 and obtains a correction value for the driving amount (rotational angle) based on the obtained variation amount. Alternatively, it is also useful to obtain the variation in the conveyance amount for each of the phase sections S1 to S8 and obtain a correction value for the rotational speed (angular rate of rotation) based on the obtained variation amount.

As mentioned above, the recording apparatus actually measures a periodic conveyance variation amount or acquires a calculative value thereof for each rotational phase interval according to a combination of conveyance rollers that cooperatively convey a recording medium. The recording apparatus changes a rotational amount of each conveyance roller based on the periodic conveyance variation amount according to the phase of each conveyance roller in an actual recording operation. The calculation is based on the premise that a cooperative conveyance amount by a plurality of conveyance units is a weighted average of the conveyance amounts by respective conveyance units that can be expressed using weighting coefficients of respective conveyance units that can indicate the robustness against slippage under application of load.

As mentioned above, the recording apparatus according to the present invention performs periodic conveyance variation amount correction for each conveyance state in response to a periodic conveyance variation in the conveyance state in which a single or a plurality of conveyance rollers is operative, and can improve the quality of an entire image area.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-203088 filed Sep. 14, 2012, which is hereby incorporated by reference herein in its entirety.

What is claimed is:

1. A conveyance apparatus, comprising:

a first conveyance unit configured to convey a sheet in a conveyance direction; and a second conveyance unit disposed on a downstream side of the first conveyance unit in the conveyance direction and configured to convey the sheet in the conveyance direction, wherein the conveyance apparatus corrects a rotational amount of each conveyance unit using a correction value dedicated to each rotational phase of each conveyance unit for each of conveyance states, that is, in a first conveyance state in which the first conveyance unit is operative to convey the sheet, a second conveyance state in which the first and second conveyance units are cooperative to convey the sheet, and a third conveyance state in which the second conveyance unit is operative to convey the sheet.

2. The conveyance apparatus according to claim 1, further comprising:

a storing unit configured to store conveyance error amounts that correspond to respective rotational phases of the first and second conveyance units, wherein the conveyance error amounts of three conveyance states of the first conveyance state, the second conveyance state, and the third conveyance state are stored beforehand in the storing unit, and the conveyance apparatus corrects the rotational amount of each conveyance unit in a recording operation based on the conveyance error amount that corresponds to the rotational phase of each conveyance unit and each conveyance state.

3. The conveyance apparatus according to claim 1, wherein the conveyance error amount corresponding to each rotational phase in the second conveyance state is obtained as a weighted average of conveyance error amounts that correspond to respective rotational phases of the first and second conveyance units, which can be expressed using weighting coefficients indicating the robustness against slippage that may occur when the first and second conveyance units convey the sheet.

4. The conveyance apparatus according to claim 1, wherein the conveyance apparatus acquires conveyance error amounts of any two of three conveyance states of the first conveyance state, the second conveyance state, and the third conveyance state, and calculates a conveyance error amount of the remaining conveyance state, a conveyance amount in the second conveyance state, as a weighted average of the conveyance amount by the first conveyance unit in the first conveyance state and the conveyance amount by the second conveyance unit in the third conveyance state, which can be expressed using weighting coefficients indicating the robustness against slippage that may occur when the first and second conveyance units conveys the sheet, and acquires a correction value that corresponds to each rotational phase of each conveyance unit for each conveyance state.

5. A recording apparatus comprising:

a recording head that records an image on a recording medium;

a first conveyance unit configured to convey the recording medium during an image recording operation performed by the recording head;

a second conveyance unit disposed on a downstream side of the first conveyance unit in a conveyance direction of the recording medium and configured to convey the recording medium during the image recording operation; and a detection unit configured to detect origin phases of the first conveyance unit and the second conveyance unit, wherein recording apparatus corrects the rotational speed or the rotational amount of each of the first conveyance unit and the second conveyance unit using a correction value corresponding to a phase difference from the origin phase of each of the first and second conveyance units, corresponding to a first conveyance state in which the first conveyance unit is operative to convey the recording medium, a second conveyance state in which the first and second conveyance units are cooperative to convey the recording medium, and a third conveyance state in which the second conveyance unit is operative to convey the recording medium.

6. The recording apparatus according to claim 5, further comprising:

a storing unit configured to store a variation amount that indicates a periodic conveyance variation corresponding to a phase difference from the origin phase of each of the first and second conveyance units, wherein variation amounts of three conveyance states of the first conveyance state, the second conveyance state, and the third conveyance state are stored beforehand in the storing unit, and the recording apparatus acquires a correction amount of the rotational speed or the rotational amount based on the variation amount that corresponds to each conveyance state and each phase position in a recording operation.

7. The recording apparatus according to claim 5, further comprising:

a storing unit configured to store a variation amount that indicates a periodic conveyance variation corresponding to a phase difference from the origin phase of each of the first and second conveyance units; and a calculation unit configured to calculate the variation amount, with respect to a cooperative conveyance amount by a plurality of conveyance units, as a weighted average of conveyance amounts by respective conveyance units that can be expressed using weighting coefficients of respective conveyance units that can indicate the robustness against slippage under application of load, wherein variation amounts of any two of three conveyance states of the first conveyance state, the second conveyance state, and the third conveyance states are stored in the storing unit, the calculation unit calculates a calculative variation amount for the remaining conveyance state based on the variation amounts in the two conveyance states, and the calculation unit acquires a correction value of the rotational speed or the rotational amount based on the variation amount and the calculative variation amount that correspond to each conveyance state in a recording operation.

8. The recording apparatus according to claim 7, wherein the calculative variation amount is calculated by the calculation unit before the recording medium is conveyed and is stored beforehand in the storing unit.

9. The recording apparatus according to claim 7, wherein the variation amount or the calculative variation amount is a correction value indicating a difference from an ideal conveyance amount, wherein the correction for the rotational speed or the rotational amount is performed based on the correction value.

10. The recording apparatus according to claim 5, wherein the correction for the rotational speed or the rotational amount is changed according to a type or a size of the recording medium in the conveyance state in which the first and second conveyance units are cooperative to convey the recording medium.

11. The recording apparatus according to claim 5, wherein each of the first conveyance unit and the second conveyance unit includes a conveyance roller.

12. A method for controlling a recording apparatus, comprising:

a recording head that records an image on a recording medium;

a first conveyance unit configured to convey the recording medium during an image recording operation performed by the recording head;

a second conveyance unit disposed on a downstream side of the first conveyance unit in a conveyance direction of the recording medium and configured to convey the recording medium during the image recording operation; and a detection unit configured to detect origin phases of the first conveyance unit and the second conveyance unit, wherein the control method includes correcting the rotational speed or the rotational amount of each of the first conveyance unit and the second conveyance unit according to a phase difference from the origin phase of each of the first conveyance unit and the second conveyance unit, and the recording apparatus corrects the rotational speed or the rotational amount using a dedicated correction value in each of a conveyance state in which the first conveyance unit is operative to convey the recording medium, a conveyance state in which the first and second conveyance units are cooperative to convey the recording medium, and a conveyance state in which the second conveyance unit is operative to convey the recording medium.

* * * * *